United States Patent [19]

Ludwig et al.

[11] 3,995,607

[45] Dec. 7, 1976

[54] VACUUM RETARD DELAY VALVE

[75] Inventors: George Ludwig, Troy; William J. Walters, Milford, both of Mich.

[73] Assignee: The Bendix Corporation, South Bend, Ind.

[22] Filed: Apr. 14, 1975

[21] Appl. No.: 567,582

[52] U.S. Cl. ..... 123/117 A; 137/468; 137/513.3

[51] Int. Cl.[2] ..... F02P 5/00

[58] Field of Search .... 123/117 A, 117 R, 146.5 A; 137/513.3, 468

[56] References Cited

UNITED STATES PATENTS

| | | | |
|---|---|---|---|
| 3,472,213 | 10/1969 | Walker | 123/117 A |
| 3,491,735 | 1/1970 | Walker | 123/117 A |
| 3,646,920 | 3/1972 | Vartanian | 123/117 A |
| 3,729,132 | 4/1973 | Ludwig | 123/117 A X |
| 3,804,326 | 4/1974 | McIntire | 123/117 A X |

*Primary Examiner*—Charles J. Myhre
*Assistant Examiner*—Tony M. Argenbright
*Attorney, Agent, or Firm*—Ken C. Decker; William N. Antonis

[57] ABSTRACT

An internal combustion engine for automotive vehicles is started and operated with decreased fuel enrichment when the engine is cold by delaying spark retard as the vehicle is accelerated to save fuel and reduce accumulated pollutants collected during warm up. A valve is provided between the carburetor spark port and the distributor vacuum advance cylinder to permit unrestricted airflow from the vacuum advance cylinder to the spark port at all temperatures and to restrict airflow from the spark port to the vacuum advance cylinder when the engine operating temperature is below a predetermined temperature. When the engine operating temperature attains the predetermined temperature airflow is unrestricted in both directions and the vacuum advance operates in a normal manner.

11 Claims, 2 Drawing Figures

VACUUM RETARD DELAY VALVE

The invention relates to internal combustion engines and more particularly to a method of and apparatus for operating the engine.

PRIOR ART

Internal combustion engines presently used in automobiles have an automatic choke calibrated to provide adequate fuel enrichment during cold engine operation to enable the engine to be started and to enable the vehicle to be driven immediately without any appreciable stall or sluggish operation of the engine. This fuel enrichment during cold engine operation consumes considerable fuel and excessive pollutants are accummulated while the engine is warming up to normal operating temperature.

U.S. Pat. No. 3,729,132 is directed to a thermal control valve inserted in the suction line between the carburetor spark port and the distributor vacuum advance cylinder and is used to reduce generation of oxides of nitrogen. The valve described in the above patent prevents normal spark advance at speeds below approximately 30 miles per hour when the engine ambient temperature is above approximately 60° F but permits normal engine operation at speeds above 30 miles per hour at any temperature and at speeds below 30 miles per hour when the engine ambient temperature is below 60° F.

SUMMARY OF THE INVENTION

The present invention is directed to decreasing fuel enrichment during cold engine operation. The reduction in fuel enrichment saves fuel and considerably reduces the accummulated pollutants collected during warm up yet does not affect the initial starting of the cold engine. However, with a lean fuel mixture the cold engine stalls when the vehicle is accelerated. This occurs because the spark is retarded in the conventional manner due to an increase in intake manifold pressure.

The present invention overcomes this problem simply by delaying spark retard as the vehicle is accelerated when the engine is cold. There is no tendency of the cold engine to knock as the result of the advanced spark during acceleration because spark knock is not as prevelant in a cold engine as in a warm engine.

The invention contemplates a method of operating an internal combustion engine having a vacuum controlled spark advance connected to a vacuum source to advance the spark upon starting the engine when cold, including the steps of delaying spark retard upon accelerating the engine when cold to prevent engine stall, and retarding the spark in the normal manner after the engine warms up.

The invention also contemplates providing valve means between the spark advance and vacuum source having means for permitting substantially unrestricted flow in one direction from the spark advance to the vacuum source to advance the spark, means for restricting flow in the opposite direction from the vacuum source to the spark advance to delay spark retard upon accelerating the engine when cold, and means for providing substantially unrestricted flow from the vacuum source to the spark advance when the engine warms up to advance the spark in the normal manner.

DRAWINGS

FIG. 1 is a schematic diagram showing pertinent elements of an internal combustion engine for operating the engine in accordance with the invention, and FIG. 2 is a vertical section showing a valve for use in the internal combustion engine shown in FIG. 1 for operating the engine in accordance with the invention.

DETAILED DESCRIPTION OF THE INVENTION

Figure 1:
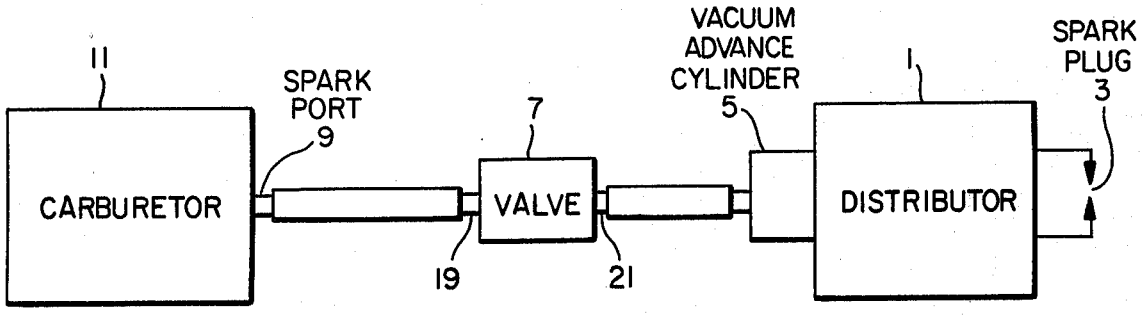

In FIG. 1 the pertinent elements for operating the engine according to the invention include a distributor 1 for supplying electrical energy to spark plugs 3, only one of which is shown. The spark is advanced in the engine cycle by a vacuum advance cylinder 5 on distributor 1 when the intake manifold pressure decreases. The vacuum advance cylinder is connected by a valve 7 to the vacuum spark port 9 in carburetor 11.

Figure 2:
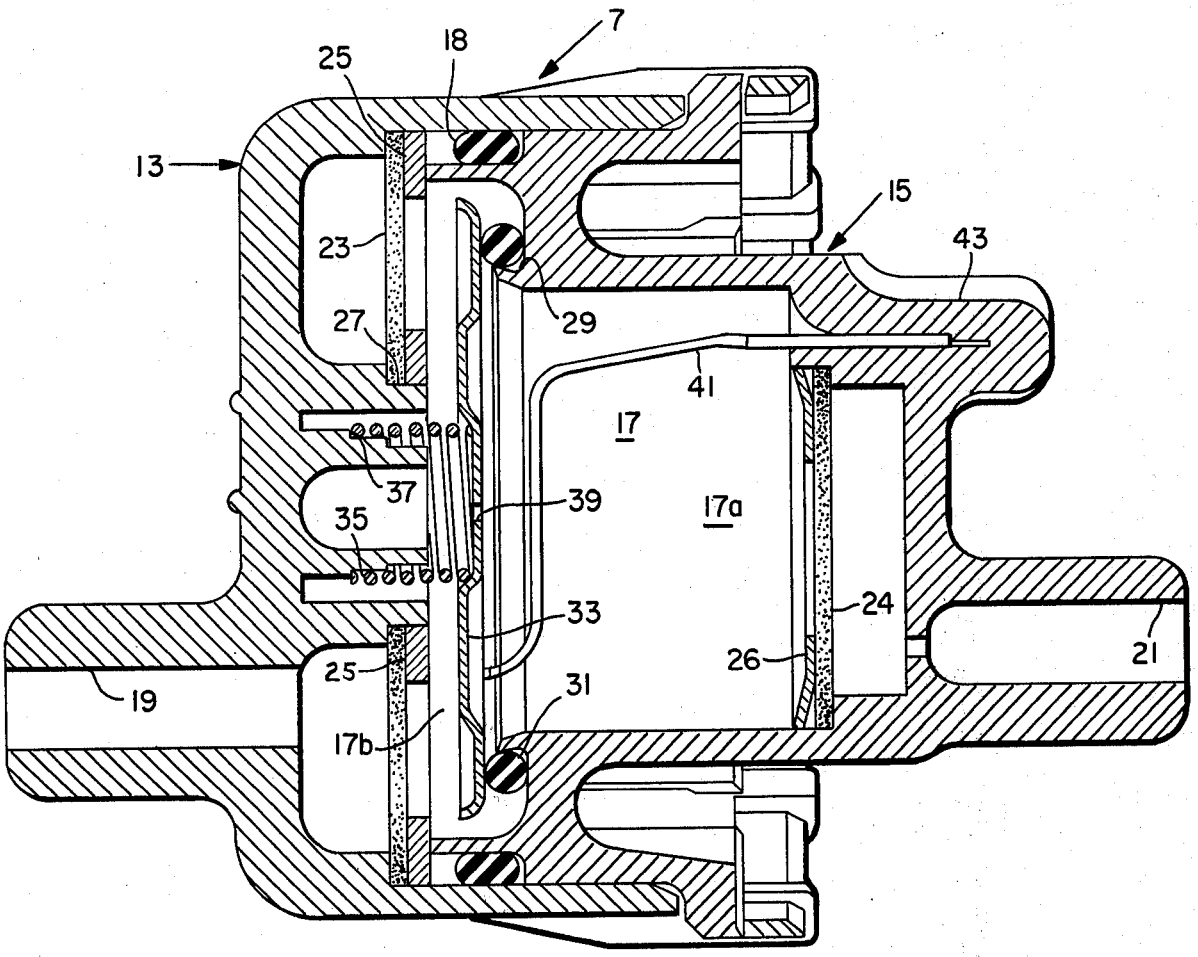

Valve 7 shown in detail in FIG. 2 has an outer cover 13 assembled on a cup-like inner cover 15 forming a cylindrical chamber 17 therebetween. An O-ring 18 is positioned between outer cover 13 and inner cover 15. Outer cover 13 has a port 19 connected to chamber 17 and inner cover 15 has a port 21 connected to chamber 17. An annular filter 23 made of suitable material is retained by washers 25 in a recess 27 in outer cover 13. A circular filter 24 is positioned in chamber 17 and retained therein by a washer 26. Filters 23 and 24 filter air as it passes through chamber 17.

Inner cover 15 has an annular groove 29 for receiving an O-ring 31. A disk 33 divides chamber 17 into two portions **17*a* and 17*b* and is urged into engagement with O-ring 31 by a coil spring 35 having one end seated on the disk and the other end seated in an annular cavity 37 in outer cover 13. Disk 33 has a calibrated orifice 39 substantially centrally thereof for restricting air flow from chamber portion 17*b* to chamber portion 17*a* so that air flow from port 19 to port 21 is restricted. The tension of spring 35 is set so that when air flows from port 21 to port 19 disk 33 is lifted off O-ring 31** in opposition to the spring and air flow in this direction is unrestricted.

An L-shaped bimetal element 41 of materials having different coefficients of expansion has one end secured to an extension 43 on inner cover 15. Bimetal element 41 extends into part **17*a* of chamber 17 and the other end of bimetal element 41 is free and is positioned adjacent disk 33. Valve 7** is positioned so bimetal element senses engine temperature.

When the engine temperature is below normal operating temperature bimetal element 41 is substantially in the position shown in FIG. 2 and when the engine temperature is at normal operating temperature the bimetal element flexes so that the free end of the bimetal element engages disk 33 and lifts the disk off of O-ring 31 in opposition to spring 35 whereby air flows unrestricted around the disk in both directions.

Port 19 of valve 7 is connected carburetor spark port 9 and port 21 of valve 7 is connected to vacuum advance cylinder 5. Air flows unrestricted in one direction from vacuum advance cylinder 5 to carburetor spark port 9 at all temperatures and air flow in the opposite direction from carburetor spark port 9 to vacuum advance cylinder 5 is restricted by orifice 39 when the engine operating temperature is below normal operating temperature. When the engine operates at the normal operating temperature air flow in both directions is unrestricted.

Operation

When a cold engine is started the fast idle cam on the automatic choke on the carburetor cracks the throttle and causes the engine to run at an idle speed higher than normal. The cracked throttle exposes the spark port to decrease intake manifold pressure thus causing vacuum advance cylinder 5 to advance the spark in the engine cycle. In the absence of valve 7, when the vehicle is accelerated using decreased fuel enrichment the engine will stall because the spark is retarded by an increase in intake manifold pressure.

In accordance with the present invention, valve 7 permits normal spark advance after the engine is started and delays spark retard for several seconds as the vehicle is accelerated when the engine is below normal operating temperature. The valve provides free air flow from vacuum advance cylinder 5 to carburetor spark port 9 and meters air flow from carburetor spark port 9 to vacuum advance cylinder 5.

Air flows freely in one direction from vacuum advance cylinder 5 through port 21 and filter 24 into chamber portion 17*a* and lifts disk 33 off of its seat in opposition to spring 35. Air flows around disk 33 into chamber portion 17*b*, through filter 23 and port 19 to carburetor spark port 9. Air flow in the opposite direction is restricted as air flows from carburetor spark port 9 through port 19 and filter 23 into chamber 17*b* through calibrated orifice 39 in disk 33 into chamber 17*a* and through filter 24 and port 21 to vacuum advance cylinder 5. This in effect traps the vacuum in the vacuum advance cylinder so that upon accelerating the vehicle spark retard will be delayed for a few seconds as air bleeds through calibrated orifice 39. After the engine warms up to normal operating temperature bimetal element 41 flexes and the free end of the bimetal element engages disk 33 and lifts the disk off of O-ring 31 in opposition to spring 35, whereby air flows unrestricted around the disk in both directions and the spark advance operates normally.

In some instances it may be more desirable or convenient to provide a separate by-pass around the valve controlled by a thermostat or other suitable means. In this event, bimetal element need not be provided in valve 7.

The present invention permits the use of leaner fuel during cold engine operation and enables the engine to be started when cold and the vehicle to be immediately driven without any appreciable stall or sluggish operation of the engine. In addition to using less fuel, the reduction in enrichment greatly reduces the pollutants accummulated during engine warm up. There is no tendency of the cold engine to knock as the result of the advanced spark during acceleration because spark knock is not as prevalent in a cold engine as in a warm engine. After the engine warms up the spark retard operates normally.

What is claimed is:

1. A method of operating an internal combustion engine with decreased fuel enrichment when the engine is cold, the engine having a vacuum controlled spark advance connected to a vacuum source, including the steps of advancing the spark in the normal manner upon starting the engine when cold, delaying spark retard upon accelerating the engine when cold to prevent engine stall, and retarding the spark in the normal manner after the engine warms up.

2. A method of operating an internal combustion engine as described in claim 1 including the step of effectively slowly bleeding the vacuum in the spark advance to delay spark retard upon accelerating the engine when cold.

3. A method of operating an internal combustion engine as described in claim 2 including the step of effectively advancing the spark at all operating temperatures after spark retard.

4. A method of operating an internal combustion engine as described in claim 2 including the step of effectively by-passing the slow bleed to retard the spark upon accelerating the engine after the engine warms up.

5. A method of operating an internal combustion engine as described in claim 4 including the step of effectively retarding the spark upon accelerating the engine above a predetermined engine operating temperature.

6. In an internal combustion engine having a vacuum controlled spark advance connected to a vacuum source to advance the spark upon starting the engine when cold, the improvement comprising valve means between the spark advance and vacuum source having means for permitting substantially unrestricted flow in one direction from the spark advance to the vacuum source to advance the spark, means for restricting flow in the opposite direction from the vacuum source to the spark advance to delay spark retard upon accelerating the engine when cold, and means for providing substantially unrestricted flow from the vacuum source to the spark advance when the engine warms up to advance the spark in the normal manner.

7. In an internal combustion engine as described in claim 6 in which the means for providing substantially unrestricted flow from the vacuum source to the spark advance when the engine warms up includes a bimetal element responsive to changes in temperature, and a valve operated by the bimetal element at a predetermined engine temperature.

8. In an internal combustion engine as described in claim 6 in which the means for restricting flow includes a restricted orifice.

9. In an internal combustion engine as described in claim 8 in which the orifice is calibrated to meter flow therethrough.

10. In an internal combustion engine as described in claim 8 in which the means for providing substantially unrestricted flow from the vacuum source to the spark advance when the engine warms up includes means responsive to engine temperature for by-passing the restricted orifice.

11. A method of operating an internal combustion engine with decreased fuel enrichment when the engine is cold, the engine having a vacuum controlled spark advance connected to a vacuum source, including the steps of permitting comparatively uninhibited communication between the vacuum source and the spark advance upon starting the engine when cold, restricting communication therebetween upon accelerating the engine when cold to prevent engine stall, and again permitting comparatively uninhibited communication between the vacuum source and the spark advance upon accelerating the engine after the engine warms up.

* * * * *